US006911940B2

(12) United States Patent
Poilasne et al.

(10) Patent No.: US 6,911,940 B2
(45) Date of Patent: Jun. 28, 2005

(54) MULTI-BAND RECONFIGURABLE CAPACITIVELY LOADED MAGNETIC DIPOLE

(75) Inventors: Gregory Poilasne, San Diego, CA (US); Laurent Desclos, San Diego, CA (US); Sebastian Rowson, San Diego, CA (US); Jeff Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 10/328,799

(22) Filed: Dec. 24, 2002

(65) Prior Publication Data

US 2004/0095281 A1 May 20, 2004

Related U.S. Application Data

(63) Continuation-in-part of application No. 10/298,870, filed on Nov. 18, 2002.

(51) Int. Cl.[7] ..... H01Q 1/36; H01Q 1/38
(52) U.S. Cl. ..... 343/700 MS; 343/876
(58) Field of Search ..... 343/700 MS, 702, 343/846, 848

(56) References Cited

U.S. PATENT DOCUMENTS

| | | | | |
|---|---|---|---|---|
| 3,648,172 A | | 3/1972 | Nakahara et al. | |
| 3,845,487 A | | 10/1974 | Lammers | |
| 4,328,502 A | | 5/1982 | Scharp | |
| 4,450,449 A | | 5/1984 | Jewitt | |
| 4,598,276 A | * | 7/1986 | Tait | 343/895 |
| 4,749,996 A | * | 6/1988 | Tresselt | 343/700 MS |
| 5,087,922 A | * | 2/1992 | Tang et al. | 343/814 |
| 5,184,144 A | | 2/1993 | Thombs | |
| 5,245,745 A | | 9/1993 | Jensen et al. | |
| 5,309,164 A | | 5/1994 | Dienes et al. | |

FOREIGN PATENT DOCUMENTS

| | | |
|---|---|---|
| EP | 0 604 338 A | 6/1994 |
| EP | 0 942 488 A | 9/1999 |
| EP | 1 067 627 A | 1/2001 |
| JP | 56 012102 | 2/1981 |
| JP | 09 055621 A | 2/1997 |
| JP | 2000 031735 A | 1/2000 |
| JP | 2000 068736 A | 3/2000 |

OTHER PUBLICATIONS

Wheeler, Harold A., Small Antennas, IEEE Transactions on Antennas and Propagation. Jul. 1975.

Sievenpiper, D.; Zhang, L; Broas, Romulo F. Jimenez; Alexopolous, Nicholas G.; Yablonovitch, Eli. High Impedance Electromagnetic Surfaces with a Forbidden Frequency Band IEEE Transactions on Microwave Theory and Techniques, vol. 47, No. 11, Nov., 1999.

*Primary Examiner*—James Vannucci
(74) *Attorney, Agent, or Firm*—Foley & Lardner LLP

(57) ABSTRACT

Designs and physical configurations for multi-frequency, low-profile, capacitively loaded magnetic dipole antennas with active elements to be used in wireless communications covering multiple band application are provided.

38 Claims, 12 Drawing Sheets

*Bottom-view of top portion*

U.S. PATENT DOCUMENTS 5,337,065 A 8/1994 Bonnet et al.
5,410,323 A * 4/1995 Kuroda ..... 343/700 MS
5,726,666 A 3/1998 Hoover et al.
5,754,143 A 5/1998 Warnagiris et al.
5,764,190 A 6/1998 Murch et al.
5,781,158 A 7/1998 Ko et al.
5,790,080 A 8/1998 Apostolos
5,835,063 A 11/1998 Brachat et al.
5,900,843 A 5/1999 Lee
5,936,583 A * 8/1999 Sekine et al. ..... 343/895
5,966,096 A 10/1999 Brachat
5,986,606 A 11/1999 Kossiavas et al.
6,002,367 A 12/1999 Engblom et al.
6,008,764 A 12/1999 Ollikainen et al.
6,046,707 A * 4/2000 Gaughan et al. ..... 343/895
6,140,965 A 10/2000 Van Hoozen
6,140,969 A 10/2000 Lindenmeier et al.
6,147,649 A 11/2000 Ivrissimtzis et al.
6,157,348 A 12/2000 Openlander
6,181,281 B1 * 1/2001 Desclos et al. ..... 343/700 MS
6,211,825 B1 * 4/2001 Deng ..... 343/700 MS
6,246,371 B1 * 6/2001 Kurz et al. ..... 343/702
6,295,028 B1 9/2001 Jonsson et al.
6,339,409 B1 * 1/2002 Warnagiris ..... 343/895
6,362,789 B1 * 3/2002 Trumbull et al. .... 343/700 MS
6,369,777 B1 * 4/2002 Ohara et al. ..... 343/895
6,381,471 B1 4/2002 Dvorkin
6,404,392 B1 6/2002 Blom
6,417,807 B1 * 7/2002 Hsu et al. ..... 343/700 MS

* cited by examiner

*Three-Dimensional View*

*Side-View*

*Bottom view of top portion*

*Three-Dimensional View*

*Bottom-view of top portion*

*Three-Dimensional View*

*Side-View*

*Bottom-View of top portion*

Front-Side-View

Front-Side-View

Front-Side-View

*Three-Dimensional View*

*Bottom-View of top portion*

*Three-Dimensional View*

*Side-View*

*Three-Dimensional View*

*Three-Dimensional View*

*Three-Dimensional View*

*Three-Dimensional View*

*Three-Dimensional View* 83

MULTI-BAND RECONFIGURABLE CAPACITIVELY LOADED MAGNETIC DIPOLE

CROSS-REFERENCE TO RELATED APPLICATIONS

This application is a continuation-in part of and claims priority from co-pending application Ser. No. 10/298,870, filed Nov. 18, 2002 entitled "Active Reconfigurable Capacitively Loaded Magnetic Dipole" by G. Poilasne et al., owned by the assignee of this application and incorporated herein by reference.

This application relates to co-pending application Ser. No. 09/892,928 entitled "Multi Frequency Magnetic Dipole Antenna Structure and Methods Reusing the Volume of an Antenna" by L. Desclos et at., owned by the assignee of this application and incorporated herein by reference.

This application relates to co-pending application Ser. No. 10/076,922, entitled "Multi Frequency Magnetic Dipole Antenna Structures with a New E-Field Distribution for Very Low-Profile Antenna Applications" by G. Poilasne et al., owned by the assignee of this application and incorporated herein by reference.

FIELD OF THE INVENTION

The present invention relates generally to the field of wireless communications, and particularly to the design of multi-band antennas.

BACKGROUND

It is desirable that wireless communication devices operate anywhere in the world. Frequency bands, however, vary from country to country and region to region. Furthermore, service providers may require use of different applications, for example, the Global System for Mobile Communications (GSM) or Personal Communications Service (PCS). Consequently, antenna designs for wireless devices need to cover multiple frequency bands as well as address the frequency requirements of service provider applications in order to function globally. The present invention addresses limitations of previously existing antenna designs.

SUMMARY OF THE INVENTION

One or more simple, efficient, low cost, small form-factor antenna design is provided comprising one or more portions and/or one or more gap formed thereby. Each antenna design provides an antenna that exhibits one or more characteristic, for example, resonant frequency or impedance characteristics. One or more control portion/element is provided with each antenna design to actively re/configure one or more of the antenna characteristics.

In one embodiment, a wireless communications device comprises a multiple band capacitively coupled dipole antenna including the following: one or more antenna characteristic, a ground portion, a conductor coupled to the ground portion and disposed in an opposing relationship to the ground portion, and a control portion/element coupled to the antenna to enable active reconfiguration of the one or more antenna characteristic.

In one embodiment, an antenna comprises one or more antenna characteristic; a ground portion; a conductor coupled to the ground portion, the conductor disposed in an opposing relationship to the ground portion; and a control portion coupled to the antenna to enable active reconfiguration of the one or more antenna characteristic. The conductor may comprise a plurality of conductor portions, and the control portion may be coupled between two of the conductor portions. The conductor may comprise a plurality of conductor portions, wherein one or more gap is defined by the conductor portions, and wherein the control portion is disposed in a gap defined by two of the conductor portions. The control portion may be disposed in a gap defined by the ground portion and the conductor, and the control portion may be coupled to the ground portion and the conductor. The antenna may further comprise a stub, wherein the stub comprises one or more stub portion, and wherein at least one stub portion is coupled to the conductor portion. A first end of a control portion may be coupled to one stub portion and a second end of a control portion may be coupled to a second stub portion. A first end of a control portion may be coupled to one stub portion and a second end of a control portion may be coupled to the ground portion. A first end of a control portion may be coupled to one stub portion and a second end of a control portion may be coupled to the conductor. The conductor may comprise a plurality of conductor portions, and a control portion may be coupled between two of the conductor portions. The conductor may comprise a plurality of conductor portions, and a control portion may be coupled between two of the conductor portions. The control portion may comprise a switch. The control portion may exhibit active capacitive or inductive characteristics. The control portion may comprise a transistor device. The control portion may comprise a FET device. The control portion may comprise a MEMs device. The ground portion and the plurality of conductor portions may be coupled to define a capacitively coupled magnetic dipole antenna. The stub may be disposed on the ground portion. The stub may be disposed between the ground portion and the conductor. The antenna may comprise a multiple band antenna.

In one embodiment, a device comprises an antenna; with the antenna comprising one or more antenna characteristic, a ground portion, a conductor coupled to the ground portion and disposed in an opposing relationship to the ground portion, and a control portion coupled to the antenna to enable active configuration of the one or more antenna characteristic. The control portion may be coupled to a conductor portion. The control portion may be coupled to a stub portion. The control portion may comprise a switch. The control portion may exhibit active capacitive or inductive characteristics. The control portion may comprise a transistor device. The control portion may comprise a FET device. The control portion may comprise a MEMs device. The ground portion and the plurality of conductor portions may be coupled to define a capacitively coupled magnetic dipole antenna.

In one embodiment, a method for actively controlling characteristics of a multiple-band capacitively coupled dipole antenna may comprise the steps of: providing a capacitively loaded dipole antenna, the antenna comprising one or more characteristic; coupling a control portion to the antenna; providing an input to the control portion; and controlling the one or more characteristic with changes to the input.

DETAILED DESCRIPTION OF THE INVENTION

Figure 1A:
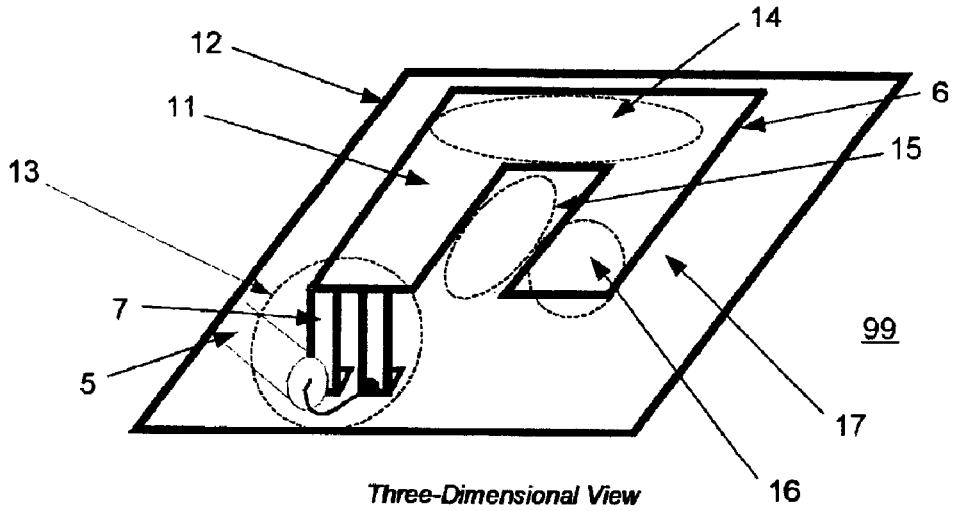
FIG. 1A illustrates a three dimensional view of an antenna.
Figure 1B:
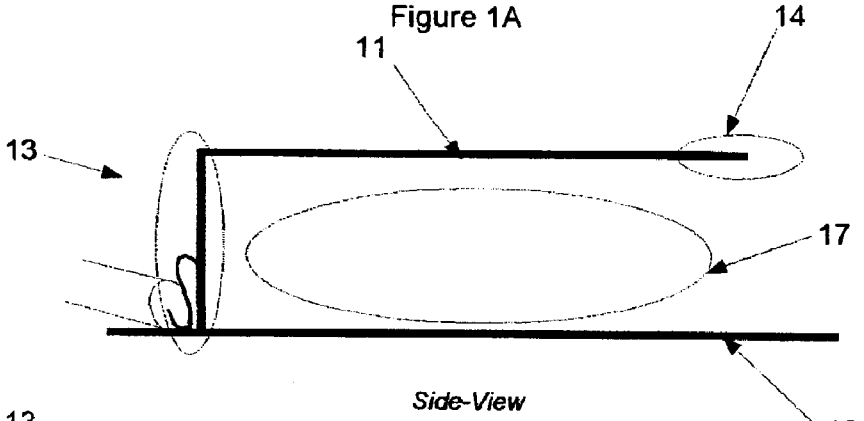
FIG. 1B illustrates a side-view of an antenna.
Figure 1C:
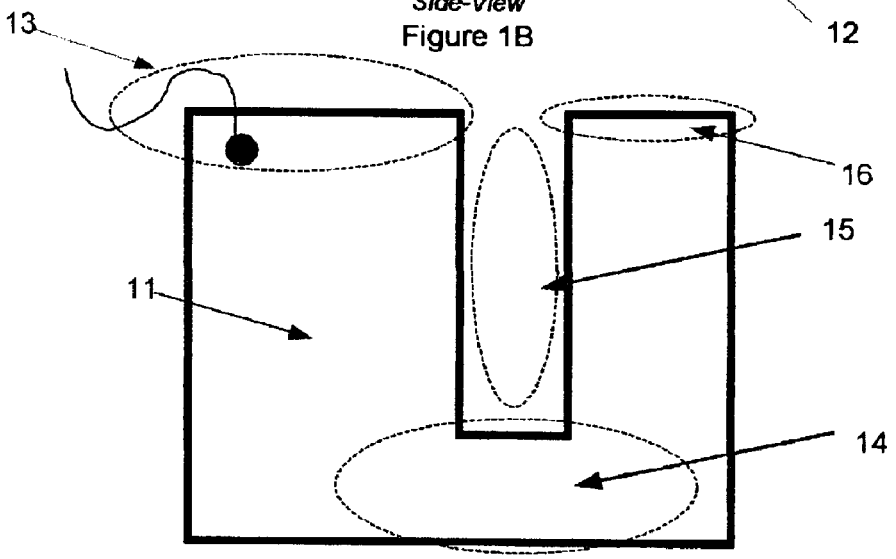
FIG. 1C illustrates a bottom-view of a top portion of an antenna.

FIGS. 1*a*, 1*b*, and 1*c* illustrate respective three-dimensional, side, and bottom views of one or more portion of a capacitively loaded magnetic dipole antenna (99). In one embodiment, antenna (99) comprises a top portion (6) disposed opposite a ground plane portion (12), with the top portion coupled to the ground plane portion by a ground connection portion (7). In one embodiment, a generally planar disposition of the top portion (6) and an opposing generally planar disposition of the ground portion (12) define a first gap area (17). In one embodiment, ground portion (12) is coupled to top portion (6) by ground connection portion (7) in an area indicated generally as feed area (13). In one embodiment, ground portion (12) comprises a ground plane. In one embodiment, within the feed area, a signal feed line portion (5) is coupled to the top portion (6). In one embodiment, the top portion (6) comprises a first portion (16) and a second portion (11), with the first portion coupled to the second portion by a connection portion (14). In one embodiment, first portion (16) and second portion (11) are opposingly disposed in a plane and define a second gap area (15). In one embodiment, one or more portion (5), (7), (11), (12), (14), and (16) may comprise conductors. In one embodiment, one or more portion (5), (7), (11), (12), (14), and (16) may comprise conductive flat plate structures. It is understood, that top portion (6) and ground plane (12) may comprise other than flat-plate structures. For example, one or more portion (5), (7), (11), (12), (14), and (16) may comprise rods, cylinders, etc. It is also understood that the present invention is not limited to the described geometries, as in other embodiments the top portion (6), the ground plane (12), the first portion (16), and the second portion (11) may be disposed relative to each other in other geometries. For example, top conductor (6) may be coupled to ground plane portion (12), and first portion (16) may be coupled to second portion (11) such that one or more of the portions are in other than parallel relationships. Thus, it is understood that antenna (99), as well as other antennas described herein, may vary in design and yet remain within the scope of the claimed invention. As will be understood with reference to the foregoing Description and Figures, one or more of portions (5), (7), (11), (12), (14), and (16), as well as other described further herein, may be utilized to effectuate changes in the operating characteristics of a capacitively loaded magnetic dipole antenna. In one embodiment, one or more of portions (5), (7), (11), (12), (14), and (16) may be utilized to alter the capacitive and/or inductive characteristics of a capacitively loaded magnetic dipole antenna design. For example, one or more of portions (5), (7), (11), (12), (14), and/or (16) may be utilized to reconfigure impedance, frequency, and/or radiation characteristics of a capacitively loaded magnetic dipole antenna.

Figure 2A:
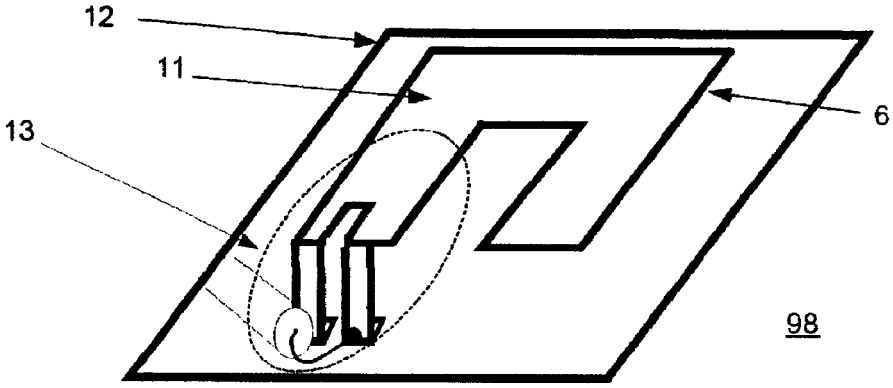
FIGS. 2A–B illustrate views of an antenna and a control portion.
Figure 2B:
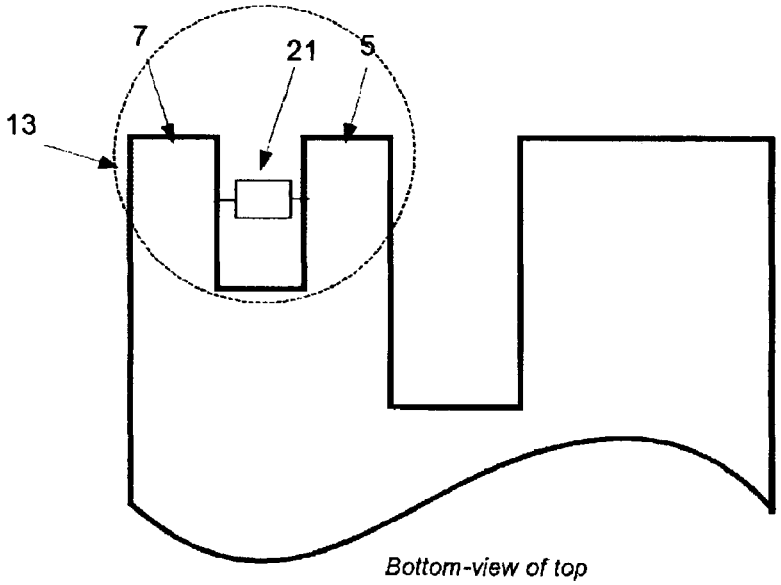

FIGS. 2*a* and 2*b* illustrate respective side and bottom views of one or more portion of a capacitively loaded magnetic dipole antenna (98), wherein antenna (98) further comprises a control portion (21). In one embodiment, control portion (21) is disposed generally within the feed area (13). In one embodiment, control portion (21) is electrically coupled at one end to the feed line portion (5) and at another end to ground connection portion (7). In one embodiment, control portion (21) comprises a device that may exhibit ON-OFF and/or actively controllable capacitive/inductive characteristics. In one embodiment, control portion (21) may comprise a transistor device, a FET device, a MEMs device, or other suitable control portion or circuit capable of exhibiting ON-OFF and/or actively controllable capacitive/inductive characteristics it has been identified that control portion (21), as well as other control portions described further herein, may be implemented by those of ordinary skill in the art and, thus, control portion (21) is described herein only in the detail necessary to enable one of such skill to implement the present invention. In one embodiment wherein the control portion (21) comprises a switch with ON characteristics, a Smith Chart loop, as used by those skilled in the art for impedance matching, is smaller than when the control portion (21) exhibits OFF characteristics. It has been identified that use of a control portion (21) with ON characteristics in the feed area (13) may be used to actively compensate for external influences on the antenna (98), for example, as by a human body. In one embodiment, wherein the capacitance/inductance of control portion (21) may be actively changed, for example, by a control input to a connection of a FET device or circuit connected between feed line (5) and connector portion (7), the control portion (21) may be used to effectuate changes in the inductance or capacitance of the antenna (98). It has been identified that the capacitance/inductance of the control portion (21) may be varied to actively change the LC characteristics of antenna (98) such that the impedance and/or resonant frequency of the antenna (98) may be actively re/configured.

Figure 3A:
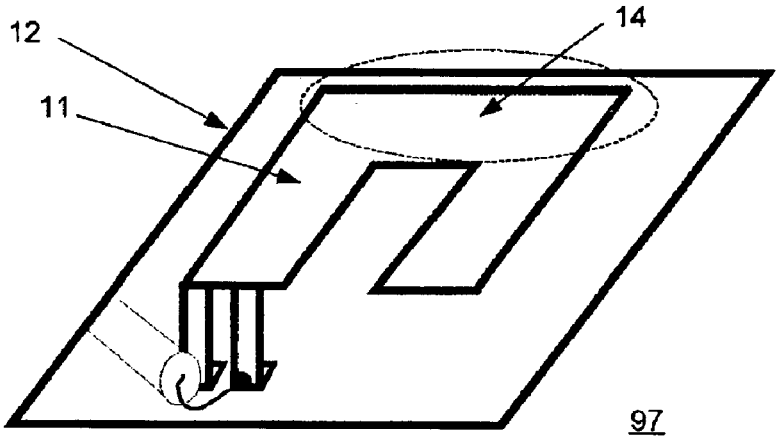
FIGS. 3A–C illustrate views of an antenna and a control portion.
Figure 3B:
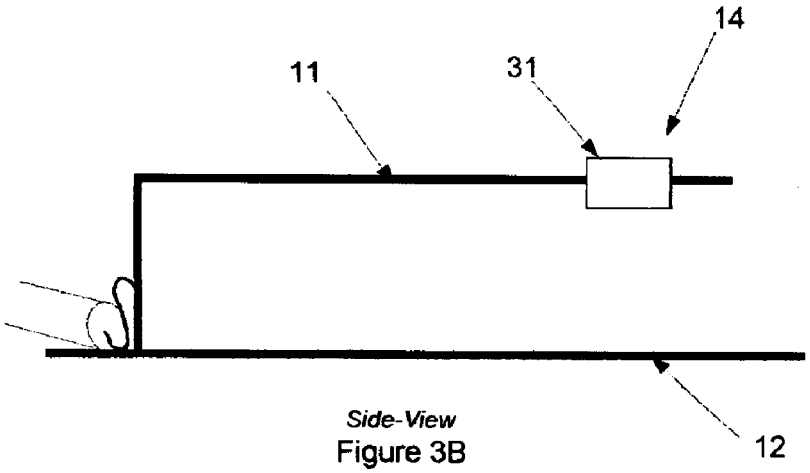
Figure 3C:
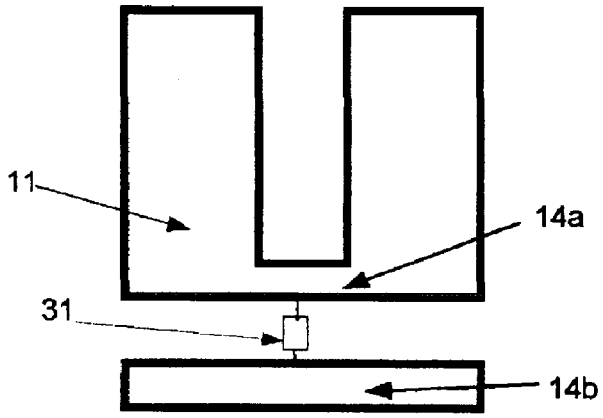

FIGS. 3*a*, 3*b*, and 3*c* illustrate respective three dimensional, side sectional, and bottom views of one or more portions of a capacitively loaded magnetic dipole antenna (97), wherein antenna (97) further comprises a control portion (31). In one embodiment, control portion (31) is disposed in an area generally defined by connection portion (14). In the one embodiment, connection portion (14) comprises a first part (14*a*) coupled to a second part (14*b*). In one embodiment, first part (14*a*) is coupled to second part (14*b*) by the control portion (31). In one embodiment, wherein the control portion (31) comprises a switch that exhibits ON characteristics, it is understood that the first and second parts of connection portion (14) may be electrically connected to each other to effectuate a larger surface geometry than in an embodiment wherein the control portion exhibits OFF characteristics.

It has been identified that with a control portion (31) coupled to connection portion (14) in a manner as generally described herein, a connection portion (14) may comprise a larger surface area and the resonant frequency of antenna (97) may thus be lowered. In one embodiment, the operating frequency of antenna (97) may be actively changed from one frequency to another, for example, between between a 800 MHz band used in the US and a 900 MHz band used in Europe for cell-phone transmitting and receiving applications. In one embodiment, wherein the capacitance and/or inductance of the control portion (31) may be actively changed, for example, by a control input to a connection of a FET device or circuit connected between the first part (14*a*) and the second part (14*b*), it has also been identified that the capacitance and/or inductance of the control portion (31) may be varied to change the LC characteristics of antenna (97) such that the resonant frequency of the antenna (97) may be actively re/configured.

Figure 4A:
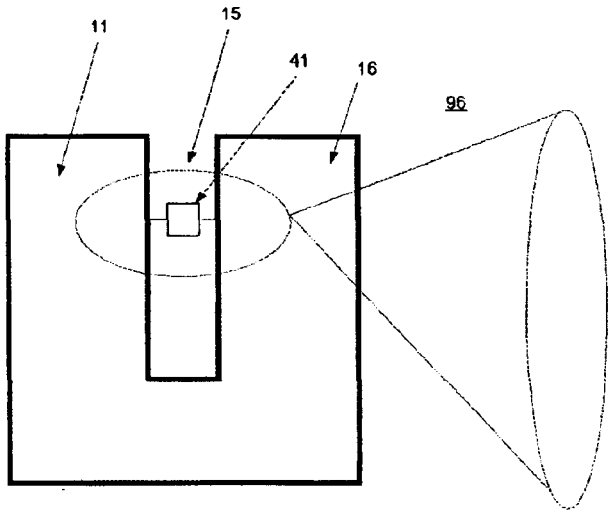
FIGS. 4A–D illustrate views of an antenna and a control portion.
Figure 4B:
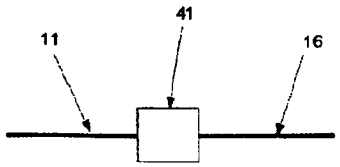

FIGS. 4*a* and 4*b* illustrate respective bottom and front-side-sectional views of one or more portions of a capacitively loaded magnetic dipole antenna (96), wherein antenna (96) further comprises a control portion (41) disposed in the general area of the second gap area (15). In one embodiment, control portion (41) is electrically coupled at one end to first portion (16) and at another end to second portion (11). In one embodiment, with a control portion (41) that exhibits ON characteristics, first portion (16) may be electrically coupled to second portion (11) so as to increase the frequency and the bandwidth of the antenna (96), compared to an embodiment where the control portion (41) exhibits OFF characteristics. In one embodiment, wherein the capacitance and/or inductance of the control portion (41) may be actively changed, the electrical coupling between the first portion (16) and the second portion (11) may be continuously controlled to effectuate changes in the inductance and/or capacitance in the second gap area (15). It has been identified that with a control portion (41) disposed generally in the gap (15) area, the resonant frequency, the bandwidth, and/or the antenna impedance characteristics may be actively re/configured.

Figure 4C:
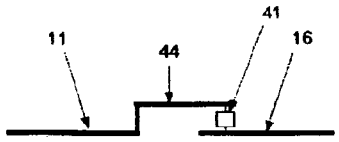

FIG. 4*c* illustrates a front-side-sectional view of one or more portion of a capacitively loaded magnetic dipole antenna (96), wherein antenna (96) further comprises a bridge portion (44) and a control portion (41) disposed in the general area of the second gap area (15). In one embodiment, bridge portion (44) is coupled to the second portion (11) to extend an area of the second portion over the first portion (16). In one embodiment, the control portion (41) is coupled at one end to the bridge portion (44) and at another end to the first portion (16).

Figure 4D:
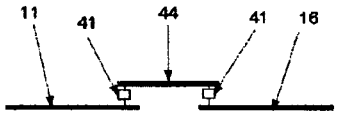

FIG. 4*d* illustrates a front-side-sectional view of one or more portion of a capacitively loaded magnetic dipole antenna (96), wherein antenna (96) further comprises a bridge portion (44) and two control portions (41) disposed in the general area of the second gap (15). In one embodiment, bridge portion (44) is disposed to extend over an area of the first portion (16) and over an area of the second portion (11). Bridge portion (44) is coupled to the first portion (16) by a first control portion (41) and to the second portion (11) by a second control portion (41). It has been identified that the control portion(s) (41) of the embodiments illustrated by FIGS. 4*c* and 4*d* may disposed generally in the gap (15) area to effectuate active control of resonant frequency, bandwidth, and impedance characteristics of antenna (96).

Figure 5A:
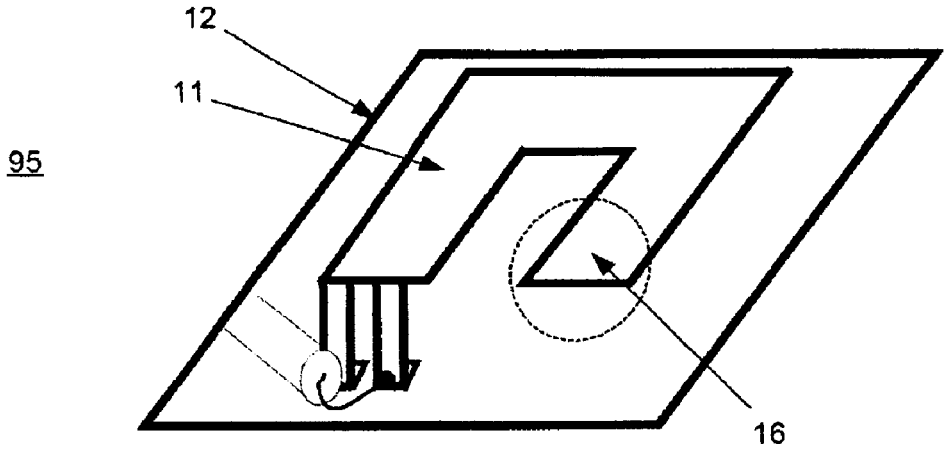
FIGS. 5A–B illustrate views of an antenna and a control portion.
Figure 5B:
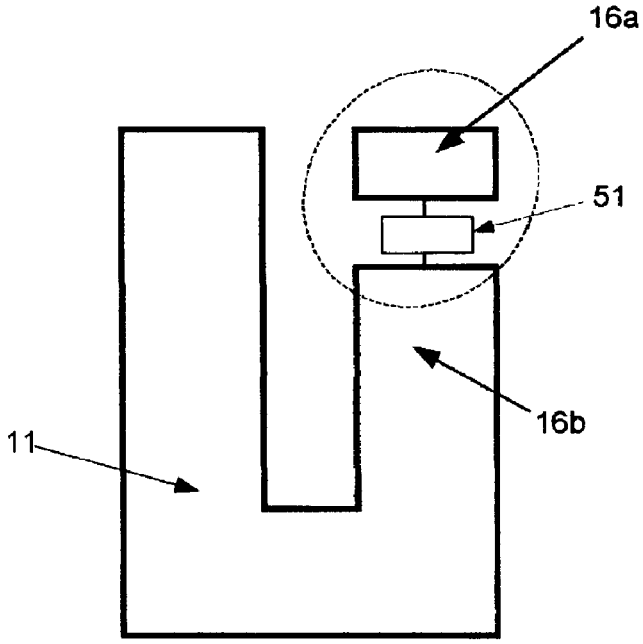

FIGS. 5*a* and 5*b* illustrate respective three dimensional and bottom views of one or more portion of a capacitively loaded magnetic dipole antenna (95), wherein antenna (95) further comprises a control portion (51) disposed in the general area of the first portion (16). In one embodiment, first portion (16) comprises a first part (16*a*) and a second part (16*b*), with the first part coupled to the second part by the control portion (51). In one embodiment, control portion (51) is coupled at one end to first part (16*a*) and at another end to second part (16*b*) such that when control portion (51) exhibits ON characteristics, the area of first portion (16) may be effectively increased. It has been identified that with a control portion (51) that exhibits ON characteristics, the resonant frequency of antenna (95) is lower than with a control portion (51) that exhibits OFF characteristics, for example, 800 MHz vs. 900 MHz. It has also been identified with a control portion (51), wherein the capacitance and/or inductance may be changed, the resonant frequency of antenna (95) may be actively re/configured.

Figure 6A:
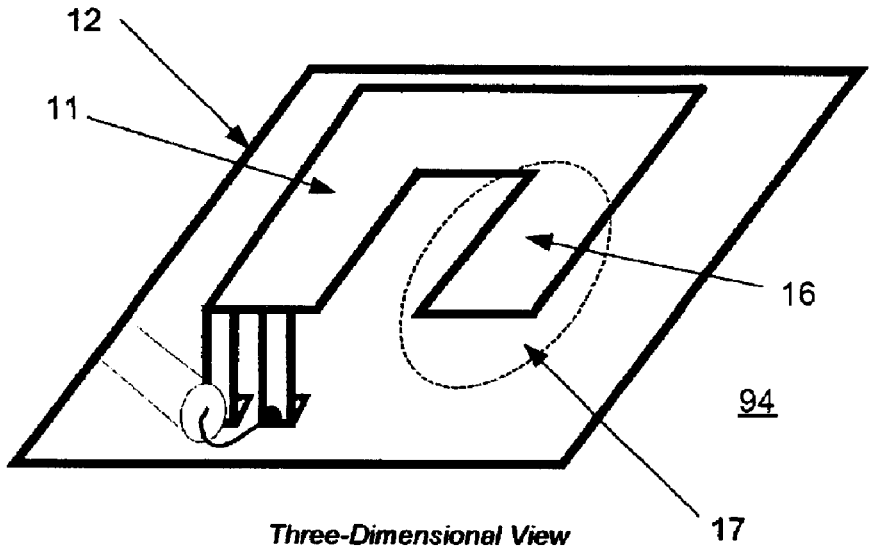
FIGS. 6A–B illustrate views of an antenna and a control portion.
Figure 6B:
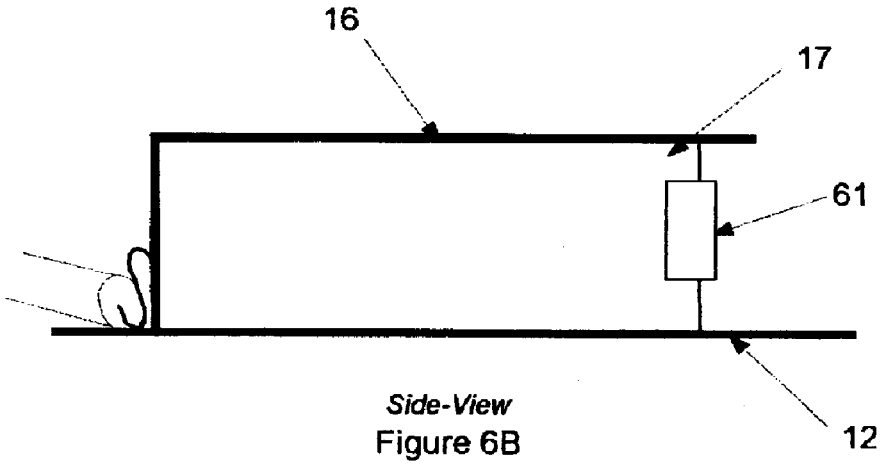

FIGS. 6*a* and 6*b* illustrate respective three dimensional and side views of one or more portion of a capacitively loaded magnetic dipole antenna (94), wherein antenna (94) further comprises a control portion (61) disposed generally in the first gap area (17) defined by the first portion (16) and the ground plane (12). It has been identified, wherein control portion (61) is coupled at one end to the first portion (16) and at another end to the ground plane (12), that when control portion (61) exhibits ON characteristics, the antenna (94) may be switched off. It has also been identified, wherein the capacitance and/or inductance of the control portion (61) may be actively changed, that the resonant frequency or impedance of antenna (94) may be actively re/configured.

Figure 7A:
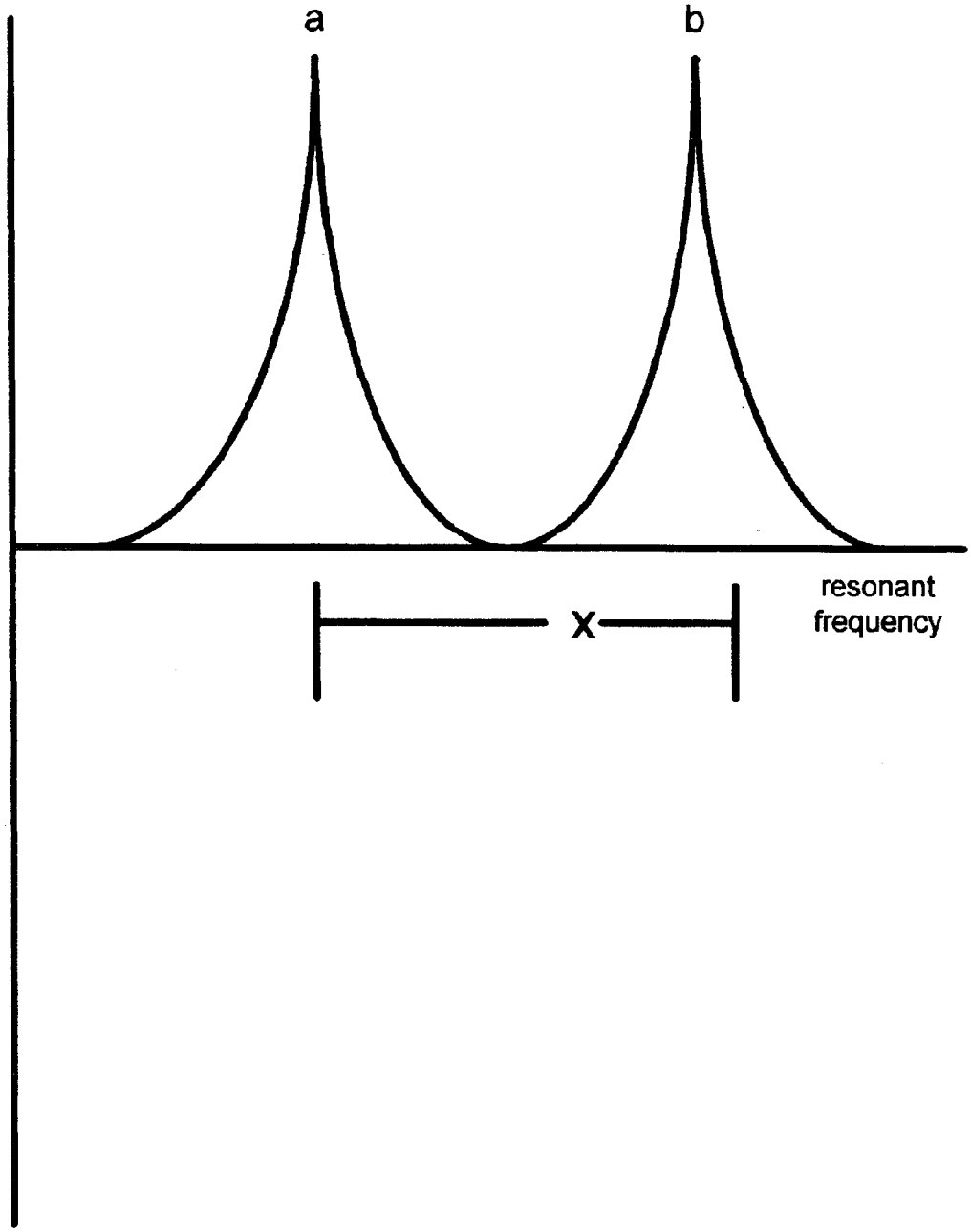
FIG. 7A illustrates resonant frequencies of a dual band capacitively loaded magnetic dipole antenna.

FIG. 7*a* illustrates resonant frequencies of a dual band capacitively loaded magnetic dipole antenna, wherein the antenna is provided with an additional resonant frequency by including one or more additional portion and/or gap in a low current density portion of the antenna. In one embodiment, a capacitively loaded magnetic dipole antenna may be provided with a lower resonant frequency (a) that spans a lower frequency band at its 3 db point and an upper resonant frequency (b) that spans an upper frequency band at its 3 db point, both resonant frequencies separated in frequency by (X), and both resonant frequencies determined by the geometry of one or more portion and/or gap as described further herein. In different embodiments it is possible to actively re/configure antenna characteristics in either their upper frequency band or their lower frequency band, or both, by disposing control portions in accordance with principles set out forth in the descriptions provided further herein.

Figure 7B:
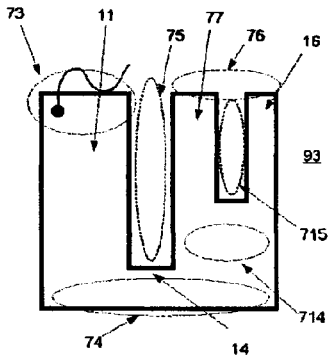
FIGS. 7B–D illustrate views of an antenna and a control portion.

FIG. 7*b* illustrates a bottom view of one or more portion of a dual band capacitively loaded magnetic dipole antenna (93), wherein antenna (93) comprises a control portion (not shown) disposed in one or more of area (73), area (74), area (75), area (76), area (714), and area (715). It is understood that although FIGS. 7*a–d* describe embodiments wherein one additional portion and/or additional gap are included to comprise a dual band antenna, the present invention is not limited to these embodiments, as in other embodiments more than one additional portion and/or more than one additional gap may be provided to effectuate creation of one or more additional resonant frequency in a capacitively loaded magnetic dipole antenna. The embodiment of FIG. 7*b* is similar to the embodiment of FIG. 1*a*, but further comprises a third portion (77). In one embodiment, the third portion (77) is coupled to a connection portion (14), and is disposed between a first portion (16) and a second portion (11). The third portion (77) enables antenna (93) to operate at two different resonant frequencies separated in frequency by (X). It is understood that when (X) approaches zero, changes made to affect antenna characteristics at one resonant frequency may affect characteristics at another resonant frequency. It has been identified that a control portion used in area (73) may be used to control the impedance of the antenna (93) in both resonant frequency bands. The areas (74, 75) provide similar function to that of the respective portion and gap (14, 15) of the single band antenna of FIG. 1 for a lower resonant frequency band. A control portion coupled to antenna (93) in area (76) may be used to affect characteristics of the antenna (93) in both lower and upper resonant frequency bands. Finally, it has been identified that the areas (714, 715) act to affect an upper resonant frequency band in a manner similar to the portion and gap (14, 15) of the single band antenna of FIG. 1.

Figure 7C:
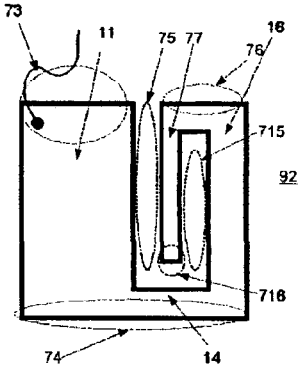

FIG. 7*c* illustrates a bottom view of one or more portion of a dual band capacitively loaded magnetic dipole antenna (92), wherein antenna (92) comprises a control portion (not shown) disposed in one or more of area (73), area (74), area (75), area (76), area (715), and area (716). The embodiment of FIG. 7*c* is similar to the embodiment of FIG. 1, but further comprises a third portion (77). In one embodiment, the third portion (77) is coupled to the first portion (16), and is disposed between first portion (16) and second portion (11). The third portion (77) enables antenna (92) to operate at one or both of an upper and lower resonant frequency. It has been identified that a control portion may be used in area (73) to control the impedance of the antenna (92) in either the lower or the upper frequency band. The areas (74, 75, 76) provide similar function to that of respective gap and portions (14, 15, 16) of the single band antenna of FIG. 1 for a lower frequency band. It has been identified that the influence of area (76) over an upper frequency band is reduced. It has also been identified that the areas (715, 716) act to affect an upper frequency band in a manner similar to the gap and portion (15, 16) of the single band antenna of FIG. 1. Finally, it has also been identified that characteristics of the antenna (92) may be altered in an lower frequency band independent of the characteristics in an upper frequency band.

Figure 7D:
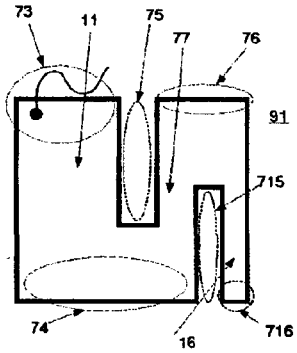

FIG. 7*d* illustrates a bottom view of one or more portion of a dual band capacitively loaded magnetic dipole antenna (91), wherein antenna (91) comprises a control portion (not shown) disposed in one or more of area (73), area (74), area (75), area (76), area (715), and area (716). The embodiment of FIG. 7*d* is similar to the embodiment of FIG. 1, but further comprises a third portion (77). In one embodiment, the third portion (77) is disposed between a first portion (16) and a second portion (11). Third portion (77) is coupled at one end to the first portion (16) by a first connection portion and at a second end to the second portion (11) by a second connection portion. The third portion (77) enables antenna (91) to operate in one or both of two different resonant frequency bands. It has been identified that a control portion may be used in area (73) to control the impedance of the antenna (91) in either a lower or upper frequency band. The areas (74, 75, 76) provide similar function to that of respective gap and portions (14, 15, 16) of the single band antenna of FIG. 1 for a lower frequency band. It has been identified that the influence of area (76) over an upper frequency band is reduced. It has also been identified that the areas (715, 716) act to affect an upper frequency band in a manner similar to the gap and portion (15, 16) of the single band antenna of FIG. 1. Finally, it has also been identified that characteristics of the antenna (91) may be altered in a lower frequency band independent of the characteristics in an upper frequency band.

Figure 8A:
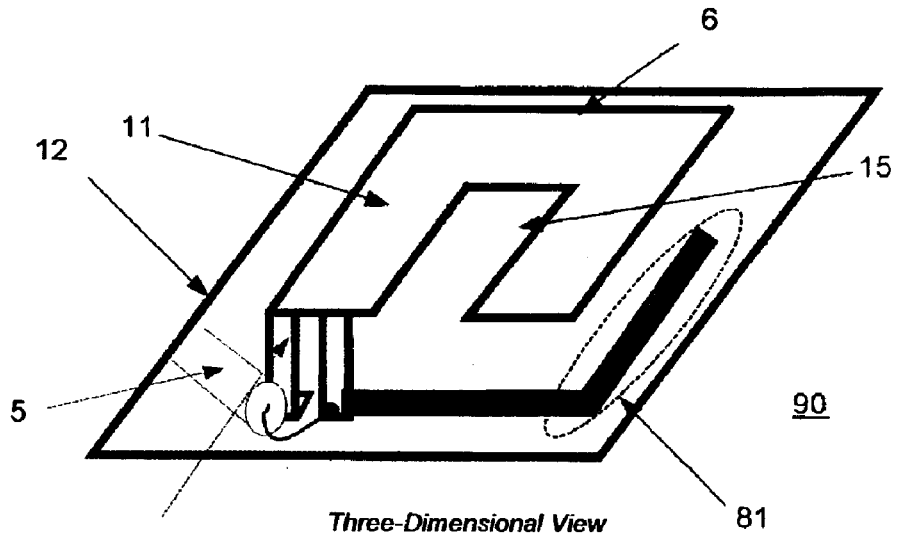
FIGS. 8A–B illustrate views of an antenna and a stub.

FIG. 8*a* illustrates a three-dimensional view of one or more portion of a capacitively loaded magnetic dipole antenna (90), wherein antenna (90) further comprises a stub (81). It has been identified that with a stub (81) coupled to an antenna in the feed area (13), for example, to a ground connection portion (7) (not illustrated) or to a feed line (5), a gap may be defined between the stub and a portion of the antenna such that an additional lower or upper antenna resonant frequency is created. By changing characteristics of the stub as described herein, it is possible to control an antenna's characteristics, for example, its impedance and lower/upper resonant frequency. In one embodiment, stub (81) comprises a printed line disposed on ground plane portion (12) and defines a gap between the stub and one or more portion of antenna (90). In one embodiment, stub (81) comprises a right angle geometry, but it is understood that stub (81) may comprise other geometries, for example straight, curved, etc. In one embodiment, stub (81) may be implemented with various technologies, for example, technologies used to create micro-strip lines or coplanar-waveguides as practiced by those skilled in the art. In one embodiment, stub (81) impedance measures 50 ohms, but other impedances are also within the scope of the present invention.

Figure 8B:
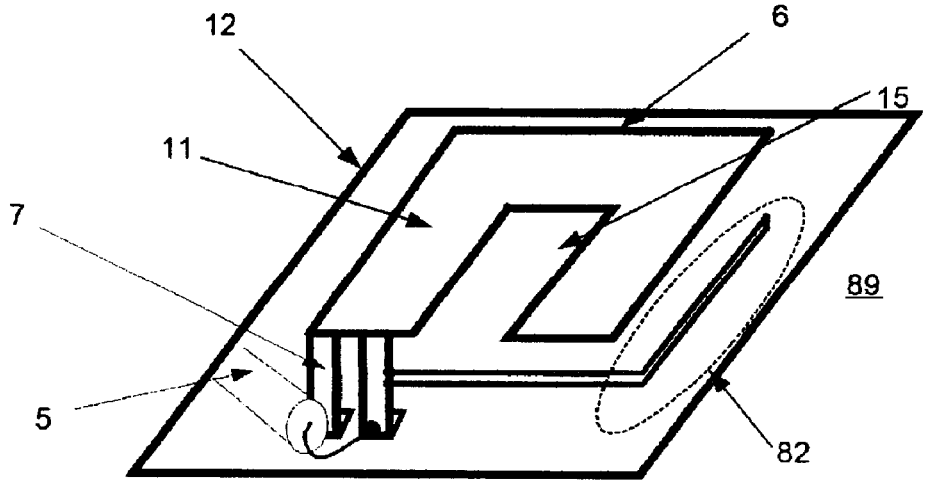

FIG. 8*b* illustrates a three-dimensional view of one or more portion of a capacitively loaded magnetic dipole antenna (89), wherein antenna (89) further comprises a stub (82) coupled to a ground connection portion (7) (not illustrated) or to a feed line (5). In one embodiment, stub (82) is disposed above the ground plane portion (12) and below one or more portions of antenna (89). In one embodiment, stub (82) may be disposed in such a way to couple directly to portion (11). In one embodiment, stub (82) comprises a right angle geometry, but it is understood that stub (82) may comprise other geometries, for example straight or curved.

Figure 9A:
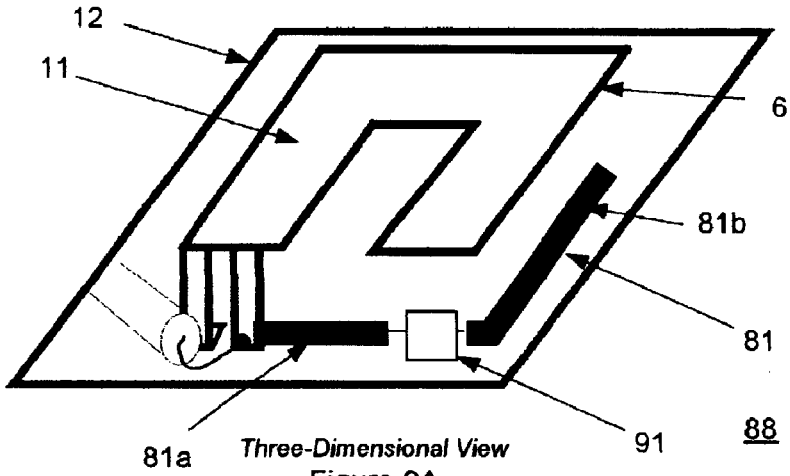
FIGS. 9A–B illustrate views of an antenna, a control portion, and a stub.

FIG. 9*a* illustrates a three-dimensional view of one or more portion of a capacitively loaded magnetic dipole antenna (88) similar to that illustrated by FIG. 8*a*, wherein antenna (88) comprises a stub (81) and a control portion (91). In one embodiment, control portion (91) is disposed to couple a first portion 81(*a*) to a second portion (81*b*) of stub (81). In has been identified that a control portion (91) that exhibits ON characteristics may be utilized to increase the length of stub (81), as compared to a control portion that exhibits OFF characteristics. It is identified that control portion (91) may thus enable control of an antenna resonant frequency created by the stub. It has also been identified that if the resonant frequency created by stub (81) is sufficiently close to the resonant frequency created by the top portion (6), control portion (91) may be used to effectuate changes in the resonant frequency or antenna characteristics created by the top portion.

Figure 9B:
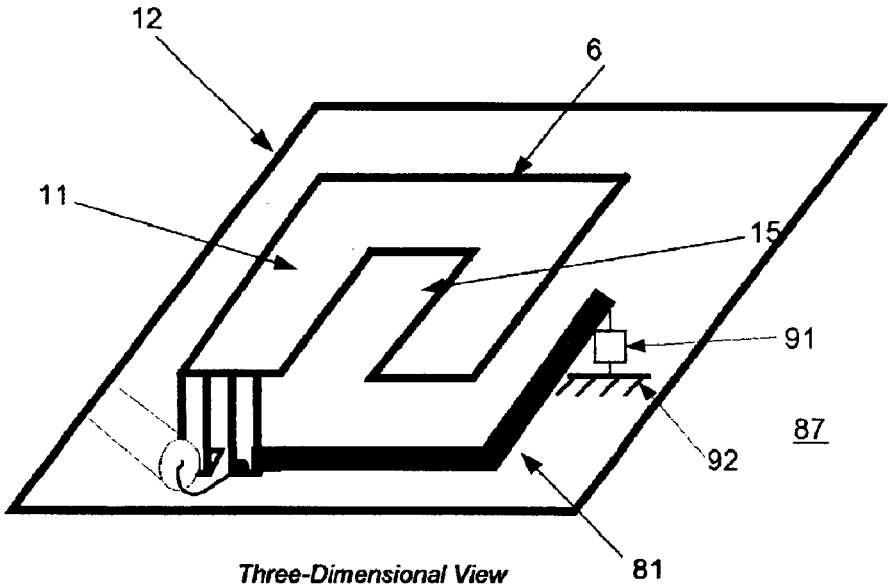

FIG. 9*b* illustrates a three-dimensional view of one or more portion of a capacitively loaded magnetic dipole antenna (87) similar to that illustrated by FIG. 8*a*, wherein antenna (87) comprises a stub (81) and control portion (91). In one embodiment, control portion (91) is disposed to couple stub (81) to the ground plane (12). It is identified that use of control portion (91) may thus enable control of an antenna resonant frequency created by the stub. It has also been identified that if the resonant frequency created by stub (81) is sufficiently close to the resonant frequency created by the top portion (6), control portion (91) may be used to effectuate changes in the resonant frequency or antenna characteristics created by the top portion.

Figure 10A:
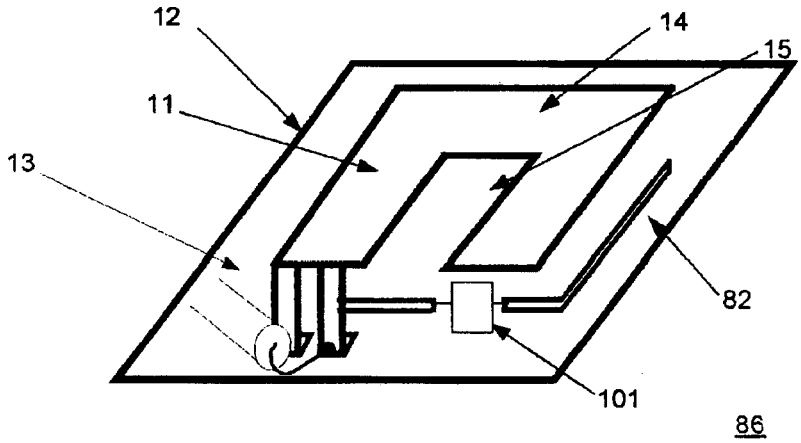
FIGS. 10A–C illustrate views of an antenna, a control portion, and a stub.

FIG. 10*a* illustrates a three-dimensional view of one or more portion of a capacitively loaded magnetic dipole antenna (86) similar to that illustrated by FIG. 8*b*, wherein the antenna comprises a stub (82) and further comprises a control portion (101) disposed to couple one part of the stub to another part of the stub. It has been identified that control portion (101) may be used to effectuate changes in the electrical length of a stub (82). It is identified that use of a control portion (101) may thus enable control of an antenna resonant frequency created by the stub. It has also been identified that if the resonant frequency created by stub (101) is sufficiently close to the resonant frequency created by the top portion (6), control portion (101) may be used to effectuate changes in the resonant frequency or antenna characteristics created by the top portion.

Figure 10B:
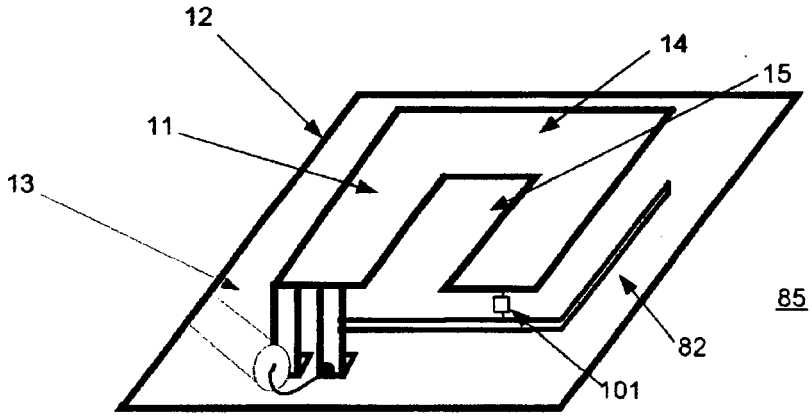

FIG. 10*b* illustrates a three-dimensional view of one or more portion of a capacitively loaded magnetic dipole antenna (85) similar to that illustrated by FIG. 8*b*, wherein the antenna comprises a stub (82) and further comprises a control portion (101) coupled to connect the stub (82) to portion (6) of antenna (85). It is identified that control portion (101) may be used to effectuate active control of characteristics of antenna (85).

Figure 10C:
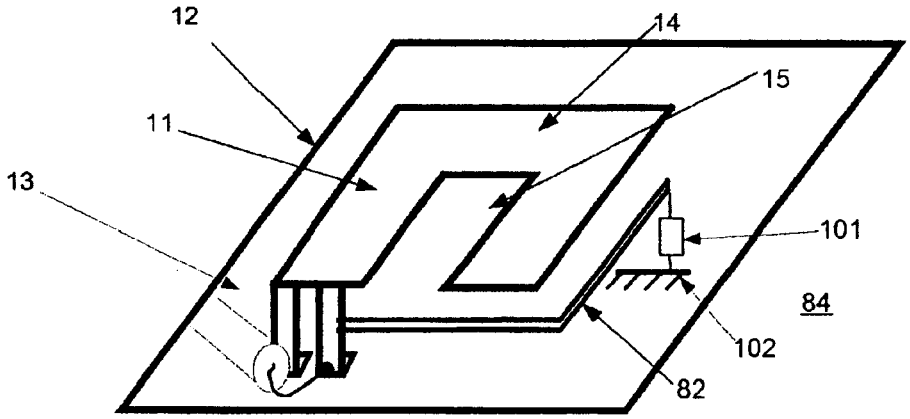

FIG. 10*c* illustrates a three-dimensional view of one or more portion of a capacitively loaded magnetic dipole antenna (84) similar to that illustrated by FIG. 8*b*, wherein the antenna comprises a stub (84) and a control portion (101) connected between the stub and a ground point(102) on the ground plane portion (12). It has been identified that the influence of the stub on the characteristics of the antenna is more drastic when the control portion (101) exhibits ON characteristics than when the control portion exhibits OFF characteristics.

It is identified that capacitively loaded magnetic dipole antennas may comprise more than one control portion to effectuate independent control of one or more characteristics of a capacitively loaded magnetic dipole antenna, for example independent control of multiple resonant frequencies of a multiple band antenna.

Figure 11A:
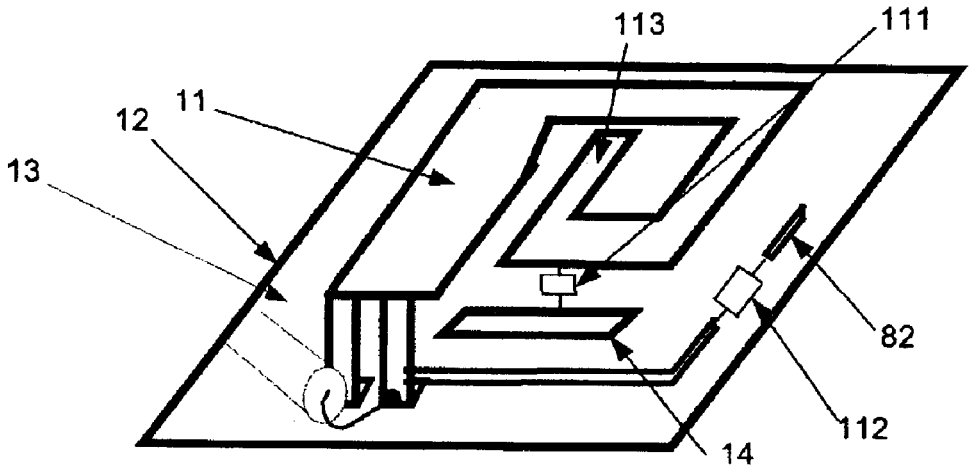
FIG. 11A illustrate views of an antenna, control portions, and a stub.

FIG. 11*a* illustrates a three-dimensional view of one or more portion of a dual band capacitively loaded magnetic dipole antenna (83), comprising a control portion (111), a control portion (112), a reconfigurable area (14) similar to that described by FIG. 3*c*, and a third portion (113) similar to that described by FIG. 7*b*. In one embodiment, antenna (83) may further comprise a reconfigurable stub (82) similar to that described by FIG. 10*a*. It has been identified that control portion (111) has influence over a lower resonant frequency band. For example, by controlling the characteristics of control portion (111) it is possible to switch the antenna (83) from 800 MHz to 900 MHz. It has also been identified that control portion (112) on the stub (82) may be used to influence an upper resonant frequency band. For example, it is possible to switch antenna (83) from 1800 MHz to 1900 MHz.

Wireless communication devices operating in one or more of frequency bands (450 MHz, 800 MHz, 900 MHz, 1.575 GHz, 1.8 GHz, 1.9 GHz, 2 GHz. 2.5 GHz, 5 GHz, . . . ) and utilizing one embodiments described herein are considered to be within the scope of the invention, for example, PDA's, cell phones, etc. Other frequency bands are also considered to be within the scope of the present invention.

Thus, it will be recognized that the preceding description embodies one or more invention that may be practiced in other specific forms without departing from the spirit and essential characteristics of the disclosure and that the invention is not to be limited by the foregoing illustrative details, but rather is to be defined by the appended claims.

What is claimed is:

1. A multi-band capacitively coupled dipole antenna comprising:

a conductive top portion including a first portion coupled to a second portion by a connection section;

a ground plane portion disposed opposite to the conductive top portion, and a control portion for enabling active reconfiguration of the antenna;

wherein one of the first portion, second portion or connection section further comprises a multipart element having a first part and a second part connected by the control portion much that activation of the control portion electrically connects the first portion and second portion to effectuate a larger surface geometry of the multipart element and deactivation of the control portion electrically disconnects the first portion and second portion to effectuate a smaller surface geometry, the change in geometry causing the antenna to be actively reconfigured.

2. The antenna of claim 1, wherein either the first portion of the second portion comprise the multipart element.

3. The antenna of claim 1, wherein the connection section comprises the multipart element.

4. The antenna of claim 1, further comprising a third portion coupled to the first portion by a second connection section.

5. The antenna of claim 4, further comprising third portion control portion connecting the third portion to the first portion for enabling active reconfiguration of the antenna.

6. The antenna of claim 1, wherein the antenna further comprises a ground connection portion connecting the conductive top portion to the ground plan portion.

7. The antenna of claim 6, further comprising a stub connected to the ground connection portion creating a gap between the antenna and the stub for generating an additional resonant frequency for the antenna.

8. The antenna of claim 1, wherein the antenna further comprises a feed line connecting the conductive top portion to an antenna feed.

9. The antenna of claim 8 further comprising a stub connected to the feed line creating a gap between the antenna and the stub for generating an additional resonant frequency for the antenna.

10. The antenna of claim 7 wherein the stub further comprises a first stub part and a second stub part connected by a stub control portion for enabling active reconfiguration of the antenna.

11. The antenna of claim 9 wherein the stub further comprises a first stub part and a second stub part connected by a stub control portion for enabling active reconfiguration of the antenna.

12. The antenna of claim 7 further comprising a stub control portion connecting the stub to the ground plane portion for enabling active reconfiguration of the antenna.

13. The antenna of claim 9 further comprising a stub control portion connecting the stub to the ground plane portion for enabling active reconfiguration of the antenna.

14. The antenna of claim 7 further comprising a stub control portion connecting the stub to the top portion for enabling active reconfiguration of the antenna.

15. The antenna of claim 9 further comprising a stub control portion connecting the stub to the top portion for enabling active reconfiguration of the antenna.

16. The antenna of claim 1, wherein the control potion comprises a switch.

17. The antenna of claim 1, wherein the control portion comprises a transistor.

18. The antenna of claim 1, wherein the control portion comprises an FET device.

19. The antenna of claim 1, wherein the control portion comprises a MEMs device.

20. A device comprising:

a multi-band capacitively coupled dipole antenna, the antenna including:

a conductive top portion including a first portion coupled to a second portion by a connection section;

a ground plane portion disposed apposite to the conductive top portion, and a control portion for enabling active reconfiguration of the antenna;

wherein one of the first portion, second portion, or connection section further comprises a multipart element having a first part and a second part connected by the control portion such that activation of the control portion electrically connects the first portion and second portion to effectuate a larger surface geometry of the multipart element and deactivation of the control portion electrically disconnects the first portion and second portion to effectuate a smaller surface geometry, the change in geometry causing the antenna to be actively reconfigured.

21. The antenna of claim 20, wherein either the first portion of the second portion comprise the multipart element.

22. The antenna of claim 20, wherein the connection section comprises the multipart element.

23. The antenna of claim 20, further comprising a third portion coupled to the first portion by a second connection section.

24. The antenna of claim 23, further comprising third portion control portion connecting the third portion to the first portion for enabling active reconfiguration of the antenna.

25. The antenna of claim 20, wherein the antenna further comprises a ground connection portion connecting the conductive top portion to the ground plan portion.

26. The antenna of claim 25 further comprising a stub connected to the ground connection portion creating a gap between the antenna and the stub for generating an additional resonant frequency for the antenna.

27. The antenna of claim 20, wherein the antenna further comprises a feed line connecting the conductive top portion to an antenna feed.

28. The antenna of claim 27, further comprising a stub connected to the feed line creating a gap between the antenna and the stub for generating an additional resonant frequency for the antenna.

29. The antenna of claim 26 wherein the stub further comprises a first stub part and a second stub part connected by a stub control portion for enabling active reconfiguration of the antenna.

30. The antenna of claim 28 wherein the stub further comprises a first stub part and a second stub part connected by a stub control portion for enabling active reconfiguration of the antenna.

31. The antenna of claim 26 further comprising a stub control portion connecting the stub to the ground plane portion for enabling active reconfiguration of the antenna.

32. The antenna of claim 28 further comprising a stub control portion connecting the stub to the ground plane portion for enabling active reconfiguration of the antenna.

33. The antenna of claim 26 further comprising a stub control portion connecting the stub to the top portion for enabling active reconfiguration of the antenna.

34. The antenna of claim 28 further comprising a stub control portion connecting the stub to the top portion for enabling active reconfiguration of the antenna.

35. The antenna of claim 20, wherein the control portion comprises a switch.

36. The antenna of claim 20, wherein the control portion comprises a transistor.

37. The antenna of claim 20, wherein the control portion comprises an FET device.

38. The antenna of claim 20, wherein the control portion comprises a MEMs device.

* * * * *